United States Patent [19]

Kurashima

[11] Patent Number: 4,975,631

[45] Date of Patent: Dec. 4, 1990

[54] CONSTANT CURRENT SOURCE CIRCUIT

[75] Inventor: Yasumi Kurashima, Tokyo, Japan

[73] Assignee: NEC Corporation, Japan

[21] Appl. No.: 453,610

[22] Filed: Dec. 20, 1989

[30] Foreign Application Priority Data

Dec. 17, 1988 [JP] Japan ..... 63-318801

[51] Int. Cl.[5] ..... G05F 3/24

[52] U.S. Cl. ..... 323/315; 323/316; 307/296.8

[58] Field of Search ..... 323/311, 312, 315, 316; 307/296.1, 296.2, 296.6, 296.8

[56] References Cited

U.S. PATENT DOCUMENTS 4,270,081 5/1981 Hareyama ..... 323/316
4,281,261 7/1981 Adam ..... 323/315
4,361,797 11/1982 Kojima et al. ..... 323/316
4,442,398 4/1984 Bertails et al. ..... 323/315
4,532,467 7/1985 Mensink et al. ..... 323/316

*Primary Examiner*—Peter S. Wong
*Attorney, Agent, or Firm*—Laff, Whitesel, Conte & Saret

[57] ABSTRACT

A constant current source circuit comprises a first FET connected to a first voltage line at its drain region and to a second voltage line through an impedance circuit at its source region and gate in common; a second FET connected to the first voltage line at its drain region and its source region and gate being connected to each other; a third FET connected to the source region of the second FET at its drain region, to the second voltage line at its source region and to the source region of the first FET at its gate; and a fourt FET connected to a current output node of the circuit at its drain region, to the second voltage line at its source region and to the source region of the second FET at its gate. Every FET is operated at the saturation state.

20 Claims, 4 Drawing Sheets

CONSTANT CURRENT SOURCE CIRCUIT

BACKGROUND OF THE INVENTION:

1. Field of the Invention

The present invention relates to a constant current source circuit, and more particularly to a constant current source circuit which includes field-effect transistors (hereinafter referred to as FETs) formed on a compound semiconductor substrate such as a semiinsulating gallium arsenide (GaAs) substrate for supplying a constant current to integrated circuits.

2. Description of Related Art

Conventional constant current source circuits of this type may include a circuit, as shown in FIG. 1, in which the source region (S) and gate (G) of an FET Q are connected to the same power voltage supply line 301 to fix its gate-source voltage (hereinafter referred to as $V_{GS}$) to zero and to thereby use the drain region (D) as a current source terminal 302. Another circuit is shown in FIG. 2, in which a resistor element R is inserted between the source region (S) of the FET Q and the power voltage supply line 301 and either an internally generated constant voltage or an externally supplied constant voltage is applied to a gate terminal 303 to thereby use the drain region (D) of the FET Q as the current source terminal 302. Either circuit causes the FET to operate at the saturation state, thereby supplying a constant current by utilizing the constant current characteristic inherent in the FET Q.

The above-mentioned conventional constant current source circuits exhibit an excellent constant current characteristic as far as the threshold voltage (hereinafter referred to as $V_T$) of the FET is constant, that is, $V_T$ keep its design value. However, the $V_T$ of FETs is inevitably deviated to some extent from the design value by manufacturing conditions, etc. and the current flowing source-drain of the FET at the saturation state is proportional to the square of the $V_T$. Therefore, large deviations in current supplied to integrated circuits through the output node of the constant current source circuit are caused from the design value of the current, thereby resulting in reduced noise margins or increased deviations of output levels from their design values for the logic circuits and output circuits utilizing the supplied current.

SUMMARY OF THE INVENTION

Accordingly, it is an object of the present invention to provide a constant current source circuit which can supply a constant current even if $V_T$ of FETs constituting the circuit is shifted from the design value.

According to feature of the present invention, there is provided a constant current source circuit which comprises a first FET, the drain region of which is connected to a first power voltage supply line and the gate and source region of which are connected to each other; an impedance element, one end of which is connected to the source region of the first FET and the other end of which is connected to a second power voltage supply line; a second FET, the drain region of which is connected to the first power voltage supply line and the gate and source region of which are connected to each other; a third FET, the drain region of which is connected to the source region of the second FET, the gate of which is connected to the source region of the first FET, and the source region of which is connected to the second power voltage supply line; and a fourth FET, the drain region of which is connected to a current supply terminal, the gate of which is connected to the source region of the second FET, and the source region of which is connected to the second power voltage supply line.

DETAILED DESCRIPTION OF THE EMBODIMENTS

Figure 3:
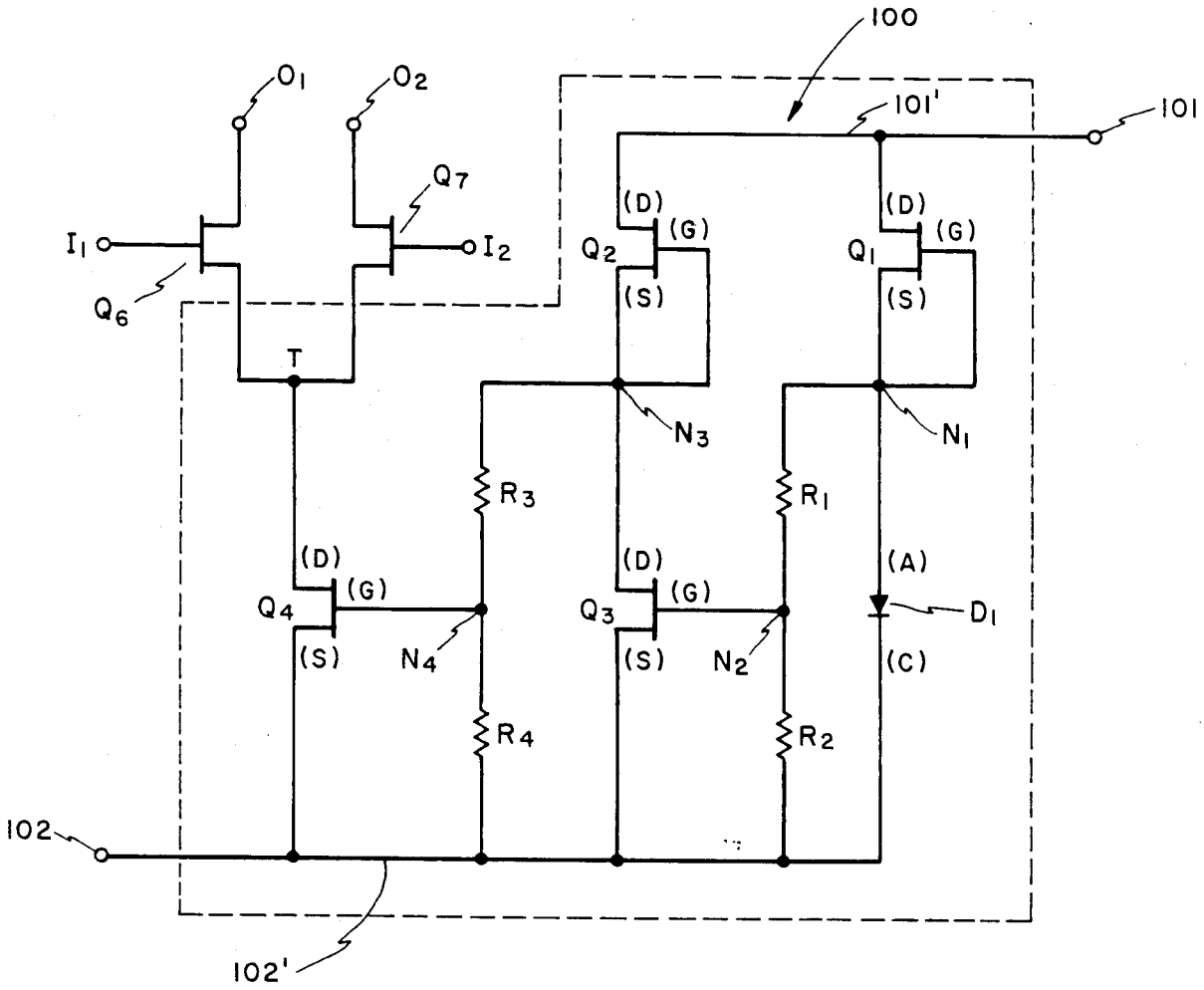
FIG. 3 is a circuit diagrams showing a first embodiment of the present invention.

Referring to FIG. 3, a first embodiment of the present invention will be explained. In this embodiment a constant current is supplied through a node T to an open-drain type differential logic circuit which includes FETs $Q_6$, $Q_7$ with an input terminal $I_1$, a reference voltage applying terminal $I_2$, and first and second output terminals $O_1$, $O_2$. By terminating the output terminals $O_1$, $O_2$ through terminal resistors (not shown), this logic circuit can provide logic operations in which the terminal potential is the high level, and the potential difference determined by the terminal resistances and the value of the constant current supplied through the node T is the logic level.

A constant current source circuit 100 (encircled by the dot line) is arranged between a high voltage power source line 101' connected to its terminal 101 and a low voltage power source line 102' connected to its - terminal 102. A first FET $Q_1$ is connected to the high voltage line 101' at its drain region (D) and to a first node $N_1$ at its source region (S) and the gate (G) in common, and a second FET $Q_2$ is connected to the high voltage line 101' at its drain region (D) and to a third node $N_3$ at its source region (S) and the gate (G) in common. An impedance means composed of a first diode $D_1$, a first resistor element $R_1$ of 10 KΩ and a second resistor element $R_2$ of 5 KΩ is coupled to the first node $N_1$ and to the low voltage line 102' such that the first diode $D_1$ is connected to the first node $N_1$ at its anode (A) and to the low voltage line 102' at its cathode (C) to be forward-biased, and that a first series resistor circuit of the first and second resistor elements $R_1$, $R_2$ is connected to the first node $N_1$ at its one end and to the low voltage line 102' at its the other end. A third FET $Q_3$ is connected to the third node $N_3$ at its drain region (D), to the low voltage line 102' at its source L region (S) and to a second node $N_2$ provided between the first and second resistor elements $R_1$, $R_2$ at its gate. A second series resistor circuit composed of a third resistor element $R_3$ of 5 KΩ and a fourth resistor element $R_4$ of 5 KΩ is connected to the third node $N_3$ at its one end and to the low voltage line 102' at its the other end. A fourth FET $Q_4$ is connected to the current output node T of this constant current source circuit at its drain region (D), to the low voltage line 102' at its source region (S) and to a fourth node $N_4$ provided between the third and fourth resistor elements $R_3$, $R_4$ at its gate (G).

These FETs are of N-channel depletion type having a $V_T$ of $-0.4$ V at the design value and are operated at the saturation state in which the value of drain-source current (hereinafter referred to as $I_{DS}$) is predominantly determined by the $V_{Gs}$ and the value of $I_{DS}$ is slightly changed by drain-source voltage (hereinafter referred to $V_{DS}$) with a gentle slope. The gentle slope characteristic of $I_{DS}$ is that even if FET is operated in the saturation state, the $I_{DS}$ is slightly increased by increasing the $V_{DS}$ and is slightly decreased by decreasing the $V_{DS}$, and the present invention employs the characteristic in the second and third FETs $Q_2$, $Q_3$ as mentioned after.

Figure 5A:
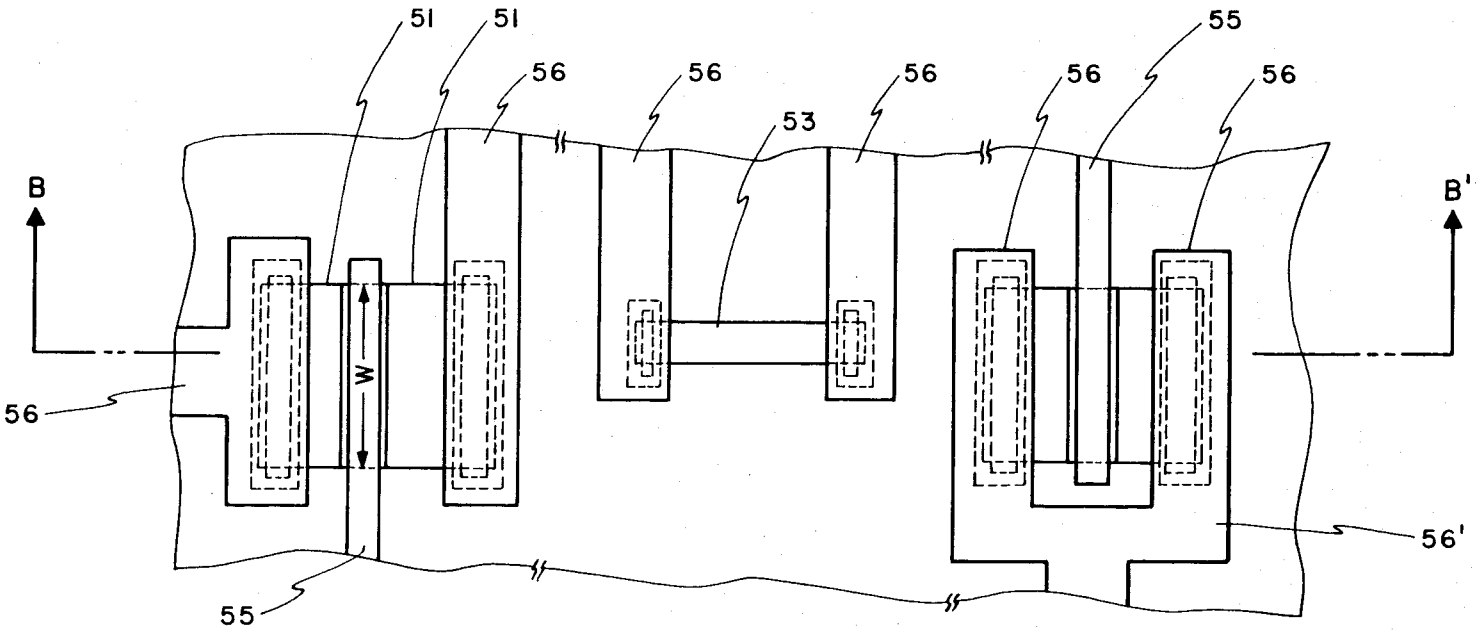
FIG. 5A is a plan view showing circuit elements used in the embodiments and FIG. 5B is a cross sectional view taken along line B-B' in FIG. 5A as viewed in the direction of the arrows.
Figure 5B:
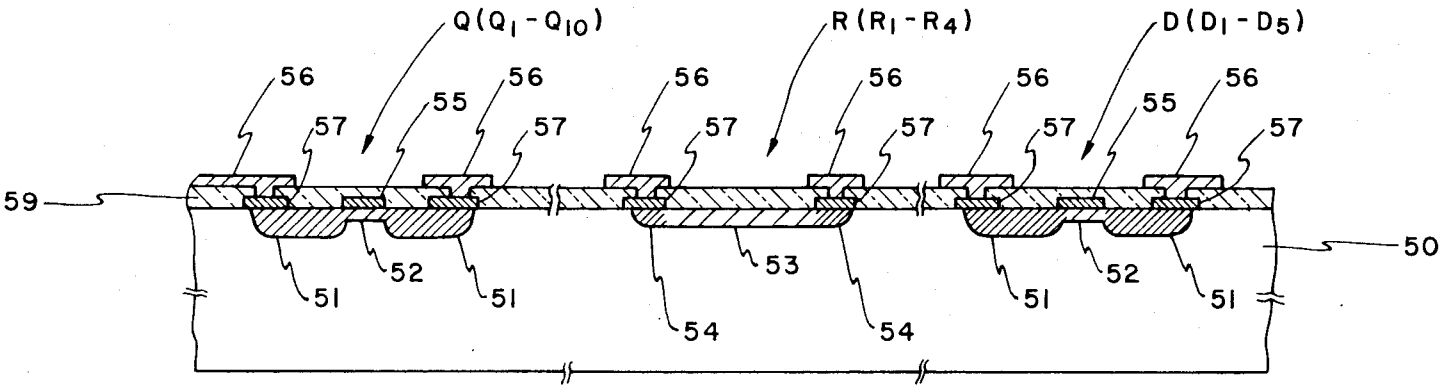

Referring to FIGS. 5A and 5B, the circuit elements (FETs Q, resistors R, diode D) shown in FIG. 3 are formed on a semi-insulating gallium arsenide (GaAs) substrate 50 to constitute the circuit of FIG. 3 on the substrate. Every FET Q is of N-channel depletion type having the $V_T$ of $-0.4$ V at the design value and has a pair of $N^+$-type high impurity concentration regions 51, 51 serving as the source and drain regions, and a N-type low impurity concentration region 52 serving as the channel region. Stripe-like electrode 55 serving as the gate is made of tungsten silicide (WSi), and is formed on and contacted to the surface of the N-type low impurity concentration region 52 to form Schottky barrier diode therebetween, and extends on the semiinsulating major surface of the substrate. Island-like electrodes 57, 57 serving as the source and drain electrodes are contacted in ohmic to the impurity regions 51, 51, and wiring layers 56, 56 are connected to the electrodes 57, 57 and are formed on an insulating layer 59 to form the circuit of FIG. 3. Every diode D is a Schottky barrier diode and has the same construction as the FET Q but the $N^+$-type impurity regions 51, 51 are commonly connected by a portion 56' (FIG. 5A) of the wiring layer 56, so that the electrode 55 serves as the anode and the N-type low impurity region 52 as the cathode. Every resistor element R has an N-type impurity region 53 which determines the resistance value of the resistor element and $N^+$-type impurity regions 54, 54 as the contact portions of the resistor element. Wirings 56, 56 are connected to the contact portions 54, 54 of the resistor element R through the electrodes 57, 57 and formed on the insulating layer 59 to form the circuit.

Returning to FIG. 3, the compensation for $V_T$ deviations in the circuit of the present invention will be explained. Let it now be supposed that $V_T$ has deviated from the design voltage in the negative side. Since $V_{GS}$ of the FET $Q_1$ is zero, any $V_T$ deviation in the negative side causes an increase in $I_{DS}$ of the FET $Q_1$. This causes an increase in the forward voltage (hereinafter referred to $V_F$) of the diode $D_1$ and also in the potential at the node $N_1$, which further causes an increase in the potential at the node $N_2$. The increase in the potential at the node $N_2$ causes an increase in $V_{GS}$ of the FET $Q_3$ and thereby an increase in $I_{DS}$ of the FET $Q_3$. However, since $V_{GS}$ of the FET $Q_2$ is zero, the increase in $I_{DS}$ of the FET $Q_3$ is absorbed by increasing $V_{DS}$ of the FET $Q_2$. The gate width W (FIG. 5A) of the second FET $Q_2$ is twice the gate width W of the third FET $Q_3$, that is, the FET $Q_2$ has the current flowing capacity twice that of the FET $Q_3$ when the same voltages are applied, and all of FETs including FETs $Q_2$, $Q_3$ are operated at the saturation state. As a result, the potential at the node $N_3$ is decreased to increase $V_{DS}$ of the FET $Q_2$ with any slightest increase in the potential at the node $N_2$ and the potential at the node $N_4$ is also decreased. On the other hand, although the $V_T$ deviation in the negative side tends to increase $I_{DS}$ of the FET $Q_4$, the potential drop at the node $N_4$ causes a decrease in $V_{GS}$ of the FET $Q_4$. This may result in offsetting the influence caused by the $V_T$ deviation in the negative side, thereby maintaining a constant $I_{DS}$ of the FET $Q_4$. This further maintains output variations at the output terminals $O_1$, $O_2$ within a prescribed range, thereby allowing stable output levels to be obtained despite $V_T$ variations.

In contrast, a $V_T$ deviation in the positive side causes a decrease in $I_{DS}$ of the FET $Q_1$, thereby causing the potentials at the nodes $N_1$, $N_2$ to fall. This further causes a decrease in $I_{DS}$ of the FET $Q_3$ and in turn causes an increase not only in the potential at the nodes $N_3$, $N_4$ with the slightest upstream current change but also in $V_{GS}$ of the FET $Q_4$, thereby allowing $I_{DS}$ of the FET $Q_4$ to be kept constant.

Figure 4:
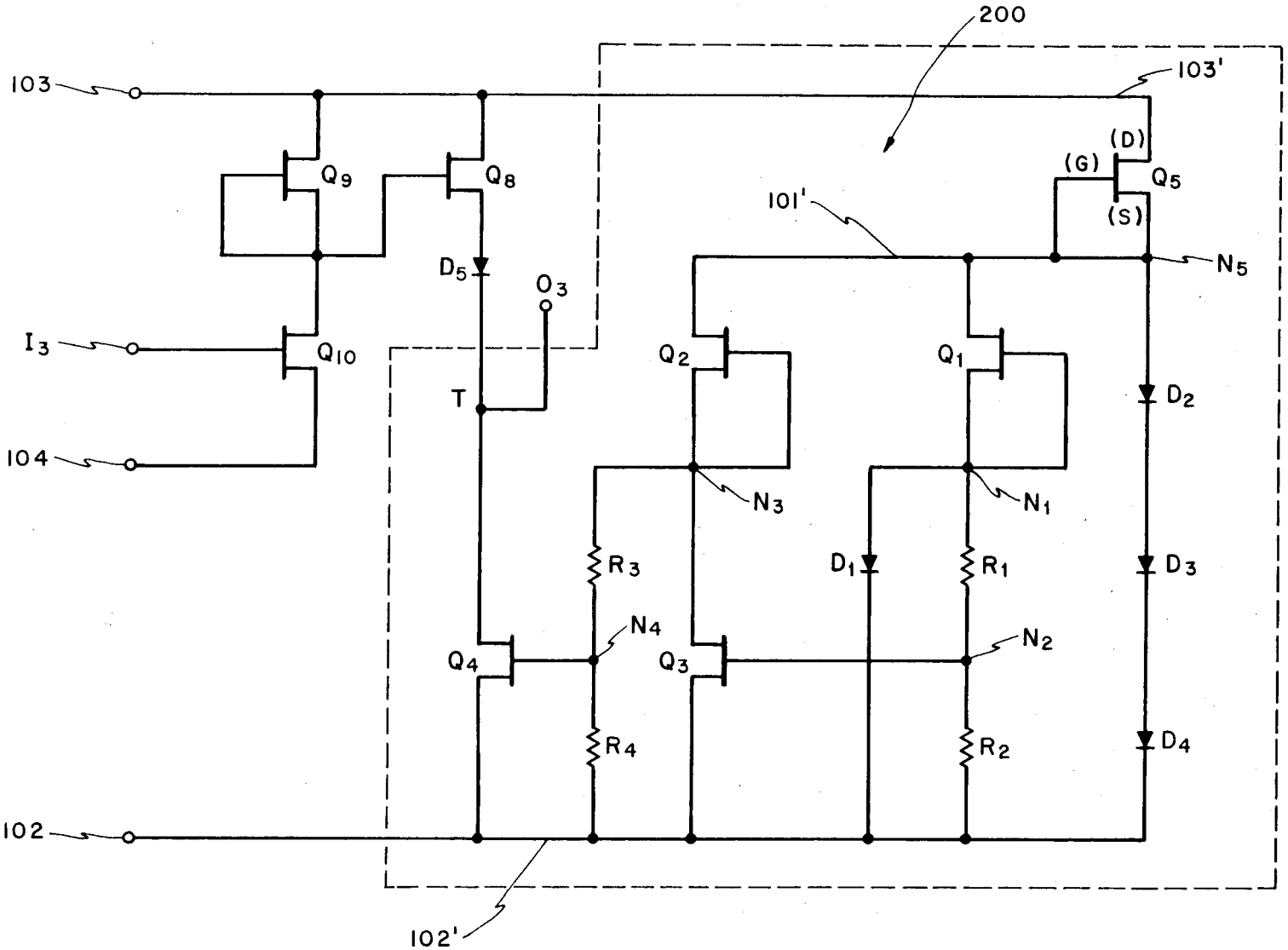
FIG. 4 is a circuit diagrams showing a second embodiment present invention.

FIG. 4 shows another embodiment of the present invention. In FIG. 4, the same components as those in FIG. 3 are indicated by the same reference numerals. In the embodiment, the constant current is supplied to a level shifting section achieved by a BFL (Buffered FET Logic) consisting of FETs $Q_8$, $Q_9$, $Q_{10}$, and a diode $D_5$/ In this circuit, the gate of the FET $Q_{10}$ is connected to an input terminal $I_3$, while the source region of the FET $Q_{10}$ is connected to a second low voltage power supply 104 and a connecting point between the cathode of the level shift diode $D_5$ and the drain region of the constant current supply FET $Q_4$ is connected to an output terminal $O_3$.

The power voltage line 101' is not connected to a terminal (terminal 101 in FIG. 3), and the voltage of the line 101' is determined by a voltage at a power voltage line 103' connected to its terminal 103, diodes and FET $Q_5$ That is, a constant current source circuit 200 (encircled by the dot line) is arranged between the high voltage line 103' and the low voltage line 102'. The FET $Q_5$ is connected to the high voltage line 103' at its drain region (D) and to the voltage line 101' or a node $N_5$ at its source region (S) and gate (G) in common, and a diode series structure consisting of diodes $D_2$, $D_3$ and $D_4$ is connected between the node $N_5$ and the low voltage line 102' so that every diode is forward-biased. In this circuit the potential at the node $N_5$ to which the source region of the FET $Q_5$ is connected is at a level three times the $V_f$ of the diode higher than the voltage at the low voltage supply line 102', whereby the line 101' connected to the node $N_5$ can be regarded as a middle voltage power supply line.

The potential at the middle voltage at the power voltage line 101' is higher than the low voltage at power supply line 102' three times $V_F$. Also, the potential at a node $N_1$ is $V_F$ higher than the voltage at the power supply' line 102' Thus, the $V_{DS}$ of the FET $Q_1$ is always two times $V_F$ and thereby operating the FET $Q_1$ at the saturation state.

Likewise, in this embodiment, a $V_T$ deviation from the design value in the negative (or positive) side causes an increase (or decrease) in the current of the FET $Q_1$ and further causes a increase (or decrease) in the potential at the nodes $N_1$ , $N_2$ and causes a decrease (or increase) in the potential at the nodes $N_3$, $N_4$ to thereby allow the $V_T$ deviation to be compensated for. In the circuit of this embodiment the potential of each node is determined based on $V_F$ of the diode referenced from the low voltage at the power supply line 102', thereby ensuring the stable performance even in the event of power supply voltage variations.

In FIGS. 3 and 4, the resistor elements are inserted only for dividing the potential difference, so that a stable performance is also ensured for resistance variations because of a wide tolerance provided in terms of their absolute accuracy, although the accuracy in dividing ratio must be well taken care of.

Figure 1:
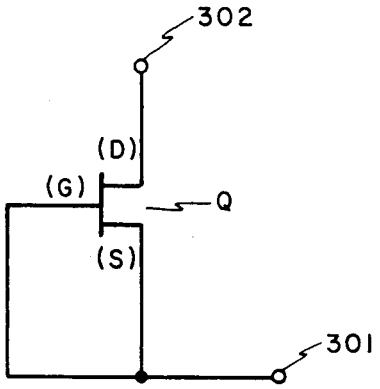
FIG. 1 (PRIOR ART)
FIGS. 1 and 2 are circuit diagrams showing conventional constant current source circuits, respectively.
Figure 2:
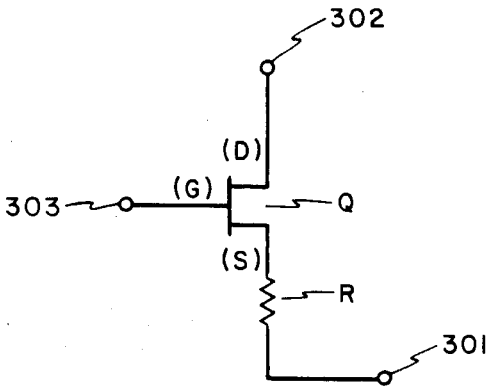
FIG. 2 (PRIOR ART)

According to the present embodiments shown in FIGS. 3, 4, when the $V_T$ of every FET is deviated by $\pm 0.2$ V from the design value of $-0.4$ V, the deviation of the current flowing through the output node T can be confined within 5% of the design value of the current. To the contrary, in the conventional circuit shown in FIG. 2, the current deviation of about 15% is caused by $V_T$ deviation of $\pm 0.2$ V from the design value of $-0.4$ V.

As explained above, in this invention any $V_T$ deviation from the design value is detected in the form of a voltage variation by the series circuit consisting of both the FET $Q_1$ and the impedance circuit to further cause the series circuit consisting of FETs $Q_2$, $Q_3$ to react with the voltage variation and to thereby correct the potential at the gate of the constant current supply FET $Q_4$ in such a manner that the $V_T$ deviation from the design value can be compensated for. Thus, according to this invention, it is possible to supply a stable current as designed despite $V_T$ deviations from the design value. Further, it is possible to stably, accurately operate a circuit which is supplied by the constant current supply circuit according to this invention.

In addition to MESFETs and JFETs, this invention may also be applied to MOSFETs. Further, as the substrate on which the circuit of the present invention, compound semiconductors other than GaAs or single semiconductor such as silicon may be applicable.

What is claimed is:

1. A constant current source circuit comprising:

a first power voltage line supplying a first voltage;

a second power voltage line supplying a second voltage lower than said first voltage;

a current output node;

a first field effect transistor having a drain region, a source region and a gate, said drain region of said first transistor being connected to said first power voltage line, and said source region and gate of said first transistor being connected to each other;

an impedance means connected between said source region of said first transistor and said second power voltage line;

a second field effect transistor having a drain region, a source region and a gate, said drain region of said second transistor being connected to said first power supply line, and said source region and gate of said second transistor being connected to each other;

a third field effect transistor having a drain region, a source region and a gate, said drain region of said third transistor being connected to said source of said second transistor, said source region of said third transistor being connected to said second power voltage line, and said gate of said third transistor being electrically connected to said source region of said first transistor; and a fourth field effect transistor having a drain region, a source region and a gate, said drain region of said fourth transistor being connected to said current output node, said source region of said fourth transistor being connected to said second power voltage line, and said gate of said fourth transistor being electrically connected to said source region of said second transistor.

2. A constant current source circuit of claim 1, in which said first to fourth transistors are N-channel type transistors.

3. A constant current source circuit of claim 1, in which said impedance means comprises a first diode element connected between said source region of said first transistor and said second power voltage line to be forward-biased, and a first series resistor circuit which includes a first resistor element and a second resistor element and is connected between said source region of said first transistor and said second power voltage line, and in which said gate of said third transistor is electrically connected to said source region of said first transistor through said first resistor element.

4. A constant source circuit of claim 3, in which said first diode element is a Schottky barrier diode element.

5. A constant current source circuit of claim 1 further comprising a second series resistor circuit which includes a third resistor element and a fourth resistor element and is connected between said source region of second transistor and said second power voltage line, and in which said gate of said fourth transistor is electrically connected to said source region of said second transistor through said third resistor element.

6. A constant current source of claim 1, in which said first to fourth transistors are compound semiconductor field effect transistors and each of said gates of said transistors forms a Schottky barrier diode.

7. A current source of claim 6, in which said first to fourth transistors are N-channel depletion type transistors.

8. A constant current source circuit of claim 1, in which said current output node is connected to a differential logic circuit for supplying a constant current to said differential logic circuit.

9. A constant current source circuit of claim 1, in which said constant current source circuit is formed on a compound semiconductor substrate.

10. A constant current source circuit of claim 9, in which said compound semiconductor substrate is a semi-insulating gallium arsenide substrate.

11. A constant current source circuit of claim 1 further comprising a third power voltage line supplying a third voltage higher than said first voltage; a fifth field effect transistor having a drain region, a source region and a gate, said drain region of said fifth transistor being connected to said third power voltage line, said source and gate of said fifth transistor being connected to said first power voltage line in common; and a series diode circuit which includes a plurality of diode elements and is connected between said first power voltage line and said second power voltage line such that each of said diode elements is forward-biased.

12. A constant current source circuit of claim 11, in which said first to fifth transistors are N-channel type transistors.

13. A constant current source circuit of claim 11, in which said impedance means comprises a first diode element connected between said source region of said first transistor and said second power voltage line to be forward-biased, and a first series resistor circuit which includes a first resistor element and a second resistor element and is connected between said source region of said first transistor and said second power voltage line, and in which said gate of said third transistor is electrically connected to said source region of said first transistor through said first resistor element.

14. A constant source circuit of claim 13, in which said first diode element and said diode elements in said series diode circuit are Schottky barrier diodes.

15. A constant current source circuit of claim 11 further comprising a second series resistor circuit which includes a third resistor element and a fourth resistor element and is connected between said source region of second transistor and said second power voltage line, and in which said gate of said fourth transistor is electrically connected to said source region of said second transistor through said third resistor element.

16. A constant current source of claim 11, in which said first to fifth transistors are compound semiconductor field effect transistors and each of said gates of said transistors forms a Schottky barrier diode.

17. A constant current source of claim 16, in which said first to fifth transistors are N-channel depletion type transistors.

18. A constant current source circuit of claim 11, in which said series diode circuit consists of second, third and fourth diode elements.

19. A constant current source circuit of claim 11, in which said constant current source circuit is formed on a compound semiconductor substrate.

20. A constant current source circuit of claim 19, in which said compound semiconductor substrate is a semi-insulating gallium arsenide substrate.

* * * * *